United States Patent [19]

Blomqvist et al.

[11] 4,011,290

[45] Mar. 8, 1977

[54] METHOD AND DEVICE FOR DISPERSING A MELT WITH A FLUID JET

[75] Inventors: Seppo Ilmari Blomqvist, Haukilahti; Launo Leo Lilja, Pori; Valto Johannes Mäkitalo, Pori; John Henrik Relander, Pori; Matti Elias Honkaniemi; Frans Heikki Tuovinen, both of Tornio, all of Finland

[73] Assignee: Outokumpu Oy, Helsinki, Finland

[22] Filed: Dec. 5, 1974

[21] Appl. No.: 529,807

[30] Foreign Application Priority Data

Dec. 19, 1973 Finland ..... 733922

[52] U.S. Cl. ..... 264/12; 261/118; 425/7

[51] Int. Cl.[2] ..... B22D 23/08

[58] Field of Search ..... 261/78 A, 115, 116, 261/118; 264/12; 425/6, 7, 10

[56] References Cited

UNITED STATES PATENTS

| | | | |
|---|---|---|---|
| 282,579 | 8/1883 | Small | 425/7 X |
| 2,048,651 | 7/1936 | Norton | 425/7 X |
| 3,421,692 | 1/1969 | Babington et al. | 261/115 X |
| 3,593,976 | 7/1971 | Hager | 425/7 X |
| 3,813,196 | 5/1974 | Backstrom et al. | 425/7 |

FOREIGN PATENTS OR APPLICATIONS

| | | | |
|---|---|---|---|
| 516,860 | 4/1921 | France | 425/10 |
| 750,610 | 8/1933 | France | 425/7 |
| 1,483,566 | 2/1969 | Sweden | 425/7 |

*Primary Examiner*—Frank W. Lutter
*Assistant Examiner*—William Cuchlinski, Jr.
*Attorney, Agent, or Firm*—Brooks Haidt Haffner & Delahunty

[57] ABSTRACT

A melt is passed as a flow into a space wherein the melt flow impinges against a deflecting surface transforming the melt flow into a thin, evenly spreaded film which, upon meeting one or more jets of a dispersing gaseous or liquid substance, is effectively dispersed.

15 Claims, 4 Drawing Figures

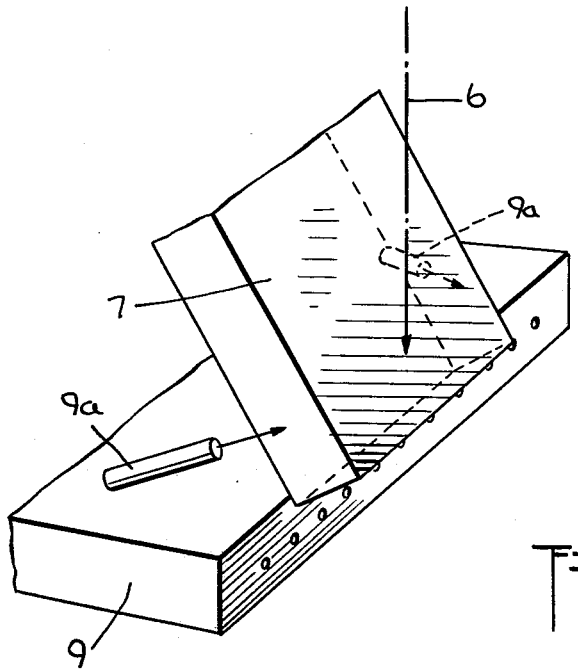
Fig. 3.
Fig. 4.
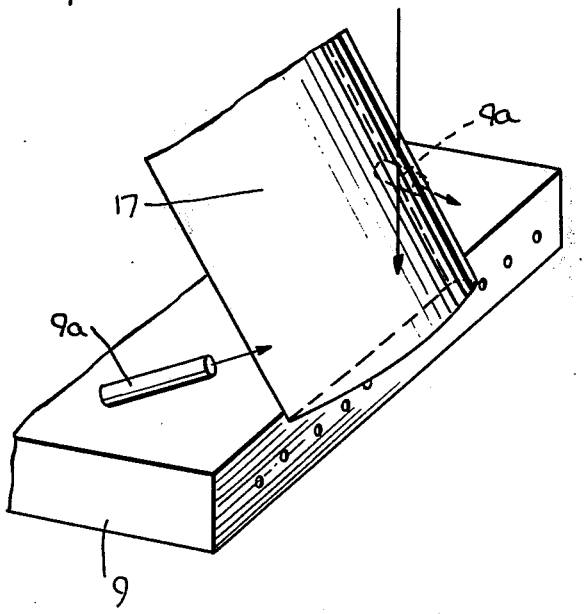

METHOD AND DEVICE FOR DISPERSING A MELT WITH A FLUID JET

FIELD OF THE INVENTION

The invention relates to a method and device for dispersing a liquid substance by means of a jet of a gaseous and/or liquid substance.

DESCRIPTION OF THE PRIOR ART

A method is known from U.S. Pat. No. 3,672,970 for refining a molten carbon-containing metal, wherein the metal is allowed to flow freely from the upper part of a reactor and the freely falling flow of melt is dispersed in the reactor by means of oxidizing gas jets which are directed slantingly downwards towards each other and emerge from nozzles fitted around the freely flowing metal flow. The oxidizing gas jets disperse the metal flow into drops with a large surface area and a relatively small size.

To achieve a selective oxidation, it is important that the melt can be dispersed into very small drops. The smaller the melt drop, the smaller the concentration gradient of carbon. If the drop is too large, carbon the melt still be present in its center when all the carbon on the drop surface has oxidized, in which case the metal on the drop surface will begin to oxidize simultaneously, thereby causing losses. The smaller the obtained drops are, the more selective the oxidation is, i.e., all of the easier oxidizing component can be removed substantially completely from the melt without the poorer oxidizing components being substantially oxidized.

In this known method, a device is used wherein the melt is fed into the reactor through an oblong narrow slit, on both sides of which slantingly downward directed nozzles have been fitted.

In terms of drop formation it would naturally be advantageous to obtain a thickness as small as possible for the melt curtain fed through the slit. In this case the width of the slit determines the thickness of the melt curtain. An arbitrarily narrow width cannot, however, be selected for the slit, for no melt can be caused to flow through too narrow a slit, and even in a slightly wider slit the slightest congelation of melt will break the melt curtain. Such congelations are very easily produced in narrow slits in which the transfer of heat from the melt to the walls of the slit is effective and the temperature of the melt is only slightly above the solidification point. In a wider slit the congelation tendency of the melt is not as strong and a possible unevenness in the wall of the slit does not notably disturb the curtain formation. Thus, it can be noted concerning this known device that a melt curtain as thin and even as possible is desired to produce drops as small as possible by means of gas jets directed at the curtain, but that the evenness of the curtain suffers if an attempt is made to reduce the thickness of the curtain below a certain limit.

Owing to the relatively thick curtain, strong gas jets must be used for dispersing it, and a relatively expensive and complicated nozzle system is required for producing these jets. The nozzles must be placed close to the melt slit to disperse the melt curtain into drops before the melt curtain puckers up. This sets high requirements on the durability of the nozzle system. The gas jets must be equally strong on both sides of the melt curtain to produce an even dispersion. To control the dispersion by means of gas jets is thus very difficult. In the performed pilot tests it was, furthermore, noted that the strong gas jets used in this known method create strong back flows which fling melt drops upwards, even as far as the nozzles, thereby damaging them. This may be partly due to the fact that strong gas jets penetrate the melt, wherein the gas expands explosively and flings melt in all directions.

Finally, it can be noted concerning this known method and device that oxidizing gases must be used in great excess to disperse into drops the curtain which is thick and therefore difficult to disperse, and only part of this gas reacts with the carbon present in the melt.

GDR Pat. No. 91,902 describes a method and device for continuous puddling of copper matte by means of air, wherein molten copper matte is fed as a wide and thin layer along a slanted melt duct into a furnace so that air nozzles place under the melt duct can disperse into drops the melt flowing over the edge of the melt duct in the form of a film.

In this case, also, the aim is to create a melt film as thin as possible and easy to disperse into drops by means of air jets placed under the melt duct and directed towards the melt film. In pilot tests we have, however, noted that even in this method, allowances must be made in regard to the thinness of the melt film, if the purpose is to simultaneously create an uninterrupted and even film. Namely, it has been noted that the melt flow continues over the melt duct as a film substantially as thick as in the melt duct. If melt is fed into the duct as too thin a layer, it puckers up and may even partly solidify owing to heat losses, as in the previous case. A greater flow velocity would decrease the risk of puckering up, but even this possibility is limited because the flow velocity can be raised only by tilting the duct to a greater angle. Furthermore, the flow velocity decreases when the layer is reduced. To decrease the risk of puckering up, the duct should be as short as possible, in which case, for structural reasons, it could not be placed at a very great angle of inclination.

Also known are devices of the former type, wherein the melt curtain is produced by causing the melt to flow in the form of a jet into a feeding funnel with a square cross section and with a narrow feeding slit in its lower part. The melt jet is caused to hit the slanted wall of the funnel throat next to the slit to spread the jet over the entire length of the slit. The melt curtain emerging from the slit is, however, similar to that in the first case, and this device has the same disadvantages.

The object of the present invention is to eliminate the disadvantages of the known methods and devices and to provide a method and device for dispersing a liquid substance with a gaseous and/or liquid substance jet, whereby the obtained layer of the substance to be dispersed is thinner than before but still even and can therefore be easily dispersed into very small drops or particles.

SUMMARY OF THE INVENTION

The method according to the invention can be used for numerous purposes. The method according to the invention can thus be applied to, for example, jet puddling of ferrochromium, to converting of sulfide matte, and to refining of steel, etc.

The substance to be dispersed must be in a flowing form, and thus mainly liquids such as metal melts, and liquid dispersions such as various suspensions are involved. On the other hand, the dispersion of gases is usually no problem.

The dispersing substance must also be in a flowing form, and thus mainly gases such as oxygen, air, or water vapor, liquids such as water, and mixtures of a gas and a liquid such as air and water can be considered. It can naturally be thought that the dispersing substance could be a pulverous substance, if use were found for such an embodiment.

Thus, by the method according to the invention, various substances can be dispersed by means of, for example, air, e.g. various liquid substances can be dispersed into drops by means of, for example, some oxidizing gas or granulated by means of water, to mention a few examples.

The method according to the present invention deviates from the previously known ones in that according to this invention the substance to be dispersed is caused, in the dispersion space, to impinge against a deflecting surface to produce a thin layer, e.g., a melt film, from the substance to be dispersed. Owing to its thinness and evenness, this layer is easy to disperse into particles or drops with a very small and even size. The dispersing is carried out by means of a jet of the dispersing substance, as in the known methods.

Thus, a much more even and thinner film or layer than previously is obtained by the method according to the invention. It may be advisable to discuss the reasons for it.

In the method according to the invention the substance to be dispersed reaches, owing to gravity, a relatively high velocity before impinging against the deflecting surface. Alternatively, it can be thought that the substance to be dispersed is sprayed from an arbitrary direction, e.g., from below upwards against the deflecting surface, but even in this case the substance to be dispersed has enough kinetic energy when it impinges against the deflecting surface to create the said film or layer. It can thus be said that the kinetic energy is partially transformed, by means of the deflecting surface, into dispersing energy to create the said film or layer. Generally speaking, it could also be said that a greater velocity of the substance to be dispersed at the impinging moment produces a thinner film or layer and the drops, granules or particles produced are finer.

On the basis of this principle it is easy to understand why the previously known methods have been so disadvantageous and why by the method according to the invention it is possible to achieve a decisively better end result than previously.

In previously known methods the melt curtain has been produced by means of either a slit or a melt duct. If, however, the slit were as narrow as the film produced by the method according to the invention is thick, no melt would flow through the slit. The heat losses and the resistance of flow would be too great. Also, the melt flowing along the melt duct is exposed to great heat losses and the melt layer closest to the duct is slowed down considerably, factors which naturally increase the risks of solidification and puckering up. It has been noted that the films produced by means of a melt duct are not nearly as even and thin as those produced by the method according to the invention.

When applying the method according to the invention, the substance to be dispersed must, according to the above principle, be sprayed with sufficient force or caused to flow from high enough onto a slanted surface. Melt cannot be caused to flow from very high because at a certain point it begins to pucker up, but the highest practicable falling height is easy to determine experimentally for the involved substance to be dispersed. Likewise, a professional can easily determine the most suitable angle of inclination for the deflecting surface without any complicated tests.

The melt flow must also be caused to impinge against the deflecting surface close to its leaving edge to prevent the puckering up of the created film or layer. The shorter the distance over which the melt is in contact with the deflecting surface, the smaller the heat losses and the resistance of flow. In the method according to the invention these factors are not, however, in proportion to the length of the deflecting surface, as in the melt duct, but to the distance of the leaving edge of the melt duct from the impinging point, which can be selected independently of the length of the deflecting surface. Likewise, the width of the deflecting surface can be selected arbitrarily; preferably it is, however, of the width of the flow of the substance to be dispersed or slightly wider, for the sake of precision of aim.

The deflecting surface can be even or curved, preferably of the shape of, for example, a paraboloid.

DESCRIPTION OF THE DRAWINGS

FIG. 3 is a detail view showing nozzles directed toward the sides of a flat tile.

FIG. 4 is a view similar to FIG. 3 showing a convex tile.

DESCRIPTION OF THE PREFERRED EMBODIMENTS

Figure 1:
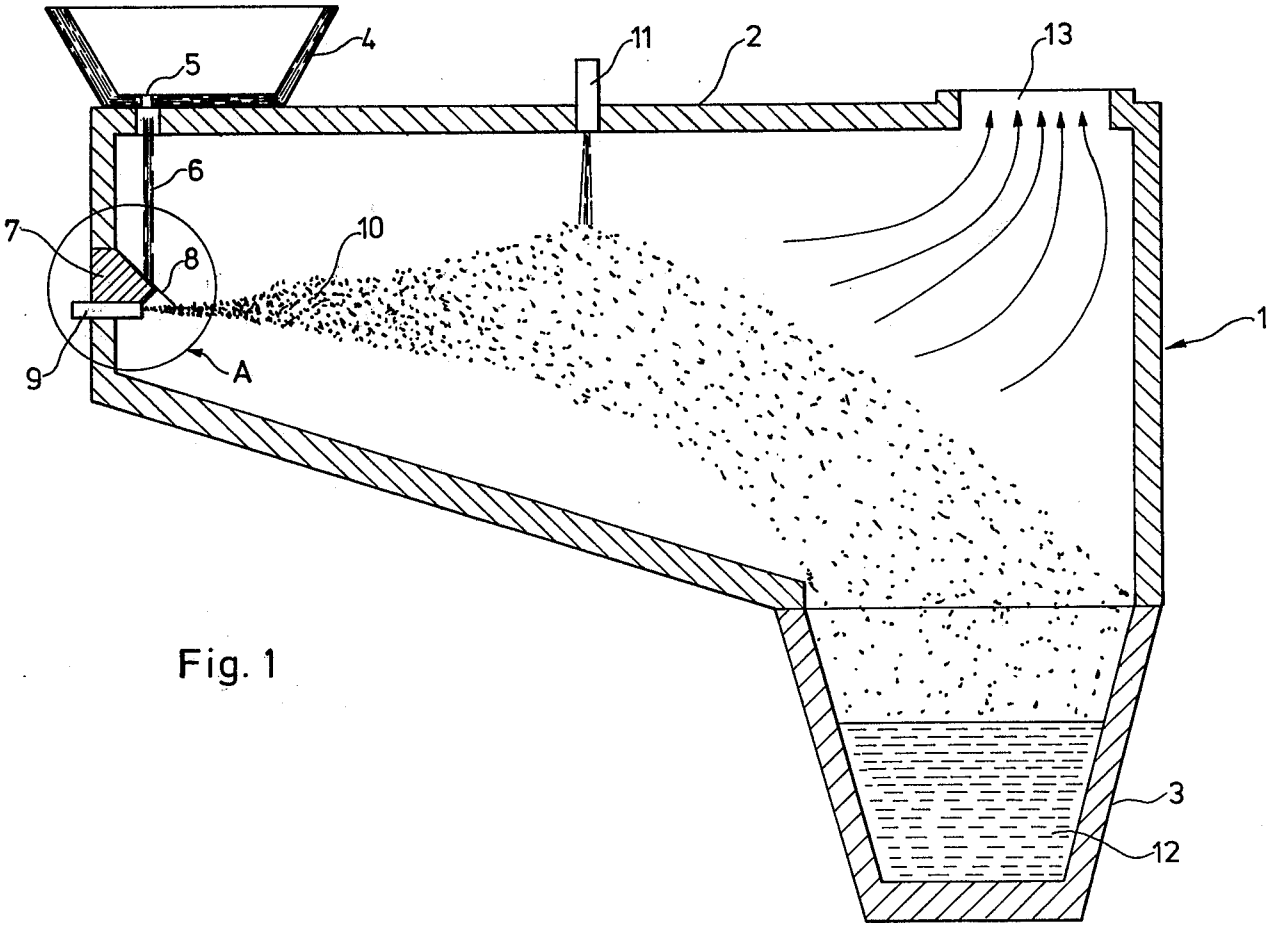
FIG. 1 shows a cross section of a schematic side view of the device adapted for carrying out the method according to the invention.
Figure 2:
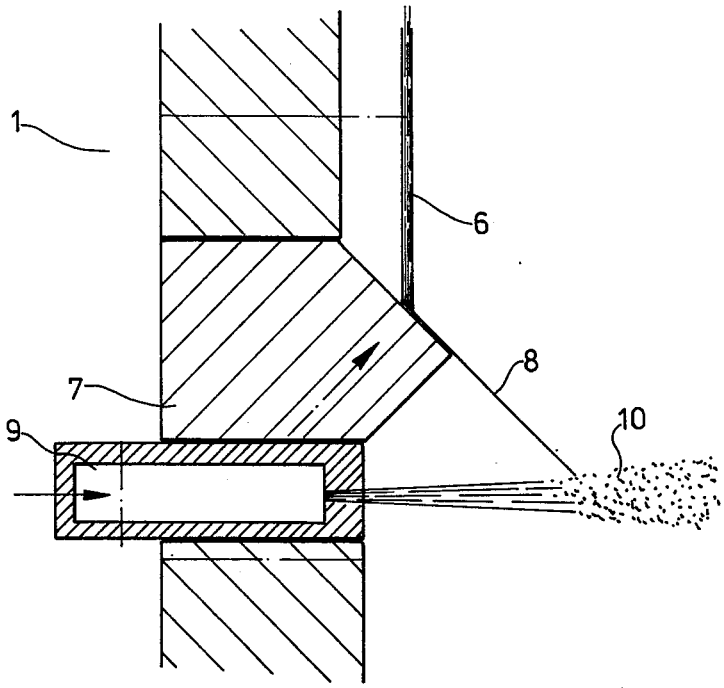
FIG. 2 shows detail A of FIG. 1 on an enlarged scale.

In FIGS. 1 and 2, the reactor is indicated by 1, the top of the reactor by 2, and the product sink by 3. Above the top 2 in the front part reactor 1 there is a pouring tank 4, at the bottom of which is a perforated tile 5 which connects the pouring tank 4 to the inner part of the reactor 1. The flow of the substance to be dispersed flowing from the tile 5 is indicated by 6 and the fan-shaped melt film deflected and created by the inclined-surfaced dispersion tile 7 is indicated by 8. The nozzles for the dispersing substance, fitted below the dispersing tile 7 are indicated by 9 and the drop mist formed from the melt film 8 under their effect is indicated by 10. To deflect and direct this drop mist 10, there are guide gas nozzles 11 in the top 2 of the reactor 1 to direct the drops downwards towards the product sink 3, in which the melt and possible slag 12 accumulate. In addition, in the back part of the reactor top 2 there is an outlet 13 for the discharge gases.

The device described above can be used in the method according to the invention for puddling ferrochromium, for example. In such a case the puddling process is divided into the following stages:

After pouring and slag separation, the ferrochromium to be refined is transferred by means of a sink to the reactor 1 and poured at a suitable rate into the pouring tank 4, from which it is allowed to flow through the perforated tile 5 into the reactor 1.

The melt flow is spread into a film by directing it onto the slanted dispersion tile 7.

The ferrochromium film is dispersed into a mist of drops 10 by side blasting it with oxygen jets 9.

Sulfur-removing and slag-forming reagents, e.g., burned lime powder, can be injected into the reaction zone.

The spray of drops and the puddling reactions are further regulated by blasting air or oxygen into the reaction zone through the nozzles 11 in the reactor top 2.

The ferrochromium and slag 12 accumulate in the product sink 3, where the after-puddling and a possible reduction of the slag take place by means of, for example, chromium silicate. Also, chemicals can be injected into the product sink with a lancet.

During the puddling the product can be cooled with, for example, ferrochromium scrap.

The discharge gases are sucked out of the reactor through the outlet 13 and a venturi washer. The flying dust is recovered in the washer. The after-combustion of the produced CO gas can be carried out in the washing part of the reactor.

The refined ferrochromium is cast after the separation of the slag.

The success of ferrochromium puddling is above all dependent on the drop formation stage, i.e., on how effectively drops are formed at the dispersion moment and what size they are. This is explained briefly below:

When ferrochromium is puddled with oxygen, the following dominant reactions can take place:

$$(1)\ \frac{1}{3}\,Cr_7C_3+\frac{1}{2}\,O_2=\frac{7}{3}\,Cr+Co$$

$$(2)\ \frac{2}{27}\,Cr_7C_3+\frac{1}{2}\,O_2=\frac{7}{27}\,Cr_2O_3+\frac{6}{27}\,CO$$

$$(3)\ \frac{2}{3}\,Cr+\frac{1}{2}\,O_2=\frac{1}{3}\,Cr_2O_3$$

$$(4)\ \frac{1}{3}\,Cr_2O_3+\frac{1}{3}\,Cr_7C_3=3Cr+CO$$

$$(5)\ Fe+\frac{1}{2}\,O_2=FeO$$

$$(6)\ Si+O_2=SiO_2$$

At lower temperatures, 1500°–1600° C, corresponding to the pouring temperature of ferrochromium (=initial temperature of puddling), reactions (2) and (3) prevail after reaction (6) has taken place, reaction (2) always before reaction (5), whereas at temperatures above 1700° C reactions (1) and (4) take place. In order that chromium be oxidized to as small as extent as possible, the temperature of the melt must be raised above 1700° C as rapidly as possible. At the drop formation moment the first reaction that takes place is the oxidation of the silicon of ferrochromium (6), which raises the temperature of the drops faster if the drops are smaller.

The ferrochromium to be refined must contain a normal amount of silicon; e.g., 2.0 % Si when burning raises the melt temperature by 420° C. The melt is dispersed into very small drops to obtain a large reaction surface advantageous for the refining, the reaction velocity of puddling being determined by the diffusion of oxygen into ferrochromium. Compared with, for example, the puddling of pig iron, the drop size is important in the removal of carbon from ferrochromium also for the reason that when the carbon content decreases below the critical value on a drop surface, the chromium on the drop surface begins to oxidize, while the carbon content in the drop center is still high. For example, at 1800° C, with a chromium content of 50 % and a pressure of 1 atm. this carbon content is 0.9 %.

To carry out the drop formation according to the above requirements, the physical stages involved in the method are described below:

The puckering point of the uninterrupted melt flow, which is dependent on the melt amount regulated mainly by adjusting the size of the opening 5 at the bottom of the pouring tanks and the melt level, determines the maximum distance of the slanted surface 7 required for the formation of the film 8.

The shape of the melt film 8 (plane-like, paraboloid, etc.) can be affected by the shape of the slanted surface 7 which can be a flat surface 7 as shown in FIG. 3 or a convex surface 17 as shown in FIG. 4. The size of the melt film 8 curving parabolically downwards and spreading even-surfaced from the tile 7 — the device which has been found the simplest in practice — can be affected not only by the distance of the tile 7 but also by its slant and width.

After having thinned out sufficiently at its edges, the melt film 8 splits into band-like parts and is further divided into drops mainly by the forces of surface tension. The size of the produced drops 10 is naturally affected by the degree of thinning of the melt film 8; the impinging point of the melt flow 6 against the slanted tile 7 has a considerable effect on this degree. The breaking up of the film 8 is made more effective by almost horizontal gas jets 9 emerging from dispersing nozzles, whereby very small melt drops 10 with a large surface area are obtained. The velocity of the produced gas-drop mixture determines the delay period and the turbulence of the mixture has an effect on the gas exchange close to the drop surface.

In order that as large a part as possible of the energy of the dispersing jets 9 be available for dispersing the melt into drops, the distance from the nozzles 9 to the film 8 should be short enough. It is noteworthy that most of the energy of a gas jet is spent in inelastic impinging between the gas and the melt, in accelerating the melt drops and the gas absorbed into the jet from outside, and in losses caused by the swelling of the gas, and only a rather small part is available for the formation of a new surface. Besides energy factors, it must be noted that when the goal is a certain drop size, a certain minimum gas velocity is also required. The third factor limiting the distance of the nozzles 9 from the melt film 8 is a continuous dilution of the gas jets by environmental gases, the amount of the latter in the jet increasing along with the distance.

The behavior of the gas-drop suspension after the dispersion point is affected by the masses and velocities of the melt and the gas jets. Considering the above, this is in practice determined by the gas jets. For this reason the drops easily hit the back wall of the reactor, close to the outlet 13, and there is the risk that they become flying dust. To prevent this, the suspension spray 10 is directed downwards by using gas jets aimed at it from the top of the reactor.

The invention is described in more detail with reference to examples, but is must be noted that it is very easy for a professional to determine the suitable parameters for each case by adjusting the feeding velocity and amount of the substance to be dispersed, the distance of the feeding point from the deflecting surface, the distance of the impinging point from the leaving edge of the deflecting surface, the slant and width of the deflecting surface, and the feeding pressure, rate and direction of the dispersing substance and by observing the evenness and width of the produced film, curtain or layer and the evenness and fineness of the produced cloud of drops, granules or particles. It is impossible to give examples of all these variables or even to determine their limits because they are dependent on the treatment circumstances, the substance to be dispersed, and the dispersing substance, all of which can vary within a very wide range.

It has been observed that the method according to the invention can be used when dispersing a melt into drops and when dispersing a pulverous concentrate with oxygen, air, and/or water vapor. There is no reason to assume that the method according to the invention would not be equally applicable to dividing liquid dispersions or to using liquids as the dispersing substance.

In this context the term "reactor" must be understood very widely. The reactor can be, for example, a granulation chamber or a corresponding treatment apparatus.

EXAMPLE 1

When molten ferrochromium was allowed to flow through a $\phi$ 15 mm opening from the height of 0.5 m at 17.4 t/h on the average onto a plane surface formed by a tile slanted at 45°, at a distance of 50 mm from the outer edge of its upper surface, at the velocity of 2.2 m/s, the width of the produced melt film was 0.35 m at a distance of 0.5 m from the deflecting surface. The total length of the uninterrupted film was 1 m. Calculating from these values, it can be noted that the film was very thin.

In the trials it was observed that the ratio between the length and the width of the film decreased when the slant of the deflecting surface increased. The size of the film increased when the falling height increased. There was a maximum height for the fall owing to the puckering up of the melt spray; if this height was surpassed, the film was momentarily broken.

The optimal impinging point against the deflecting surface for the substance to be dispersed was noted to be as close as possible to its outer edge. An increase of the distance shortened the melt film, and if a certain distance was surpassed, the formation of a melt film was totally prevented.

A reduction of the deflection surface improved film formation. It had to be at least the width of the falling melt spray. In practice, however, it was slightly wider to improve the precision of aim.

Mainly at the starting moment of the system, owing to the precision of aim, part of the melt could flow along the sides of the tile used as the deflecting surface without forming a film. To prevent this, the deflecting surface was provided with side walls. In such a case the part of the melt which hit the walls formed string-like strips of the edges of the film and the melt film was broken. This phenomenon excluded the use of a duct-formed structure as the deflecting surface. Instead, suitably directed gas jets 9a blowing at the sides of the tile as shown in FIGS. 3 and 4 were found to eliminate this problem.

EXAMPLE 2

Ferrochromiums with average carbon contents were produced with a reactor wherein the feeding and drop-forming apparatus was dimensioned as follows:

diameter of the opening of the pouring tank $\phi$ 32 mm
falling height from the opening to the dispersing tile 700 mm
slant of the tile 45° and its width 125 mm
impinging point of melt against the tile 50 mm from the tip of the tile
main nozzles, 15 of them, were at an angle of 5° directed downwards, at a distance of 273 mm from the ferrochromium film, and at such a height that the length of the produced film was 196 mm
top nozzles, 15 of them, were at an angle of 5° towards the dispersion point at a distance of 781 mm from the center line of the drop spray. The distance between the impinging points was 736 mm.

The ferrochromium rate was regulated at 30 t/h by means of the surface level in the pouring tank. Slag-forming reagents were injected into the reaction zone by means of a nozzle which had been placed in the top of the reactor. The drop spray was directed at the product sink, wherefrom the product ferrochromium was cast after slag separation. The discharge gases were sucked out through a venturi washer.

| Initial ferrochromium | | | analysis/% | | | amount | temperature |
|---|---|---|---|---|---|---|---|
| | Cr | Fe | C | Si | S | t | °C |
| a) | 53.5 | 36.2 | 7.3 | 2.5 | 0.035 | 18.0 | 1580 |
| b) | 53.8 | 36.4 | 7.5 | 1.9 | 0.040 | 15.0 | 1590 |
| Burned lime injected | | | a) 2700 kg<br>b) 1275 kg | | | | |

In case (a) a total of 2550 $Nm^3$ of oxygen was used and the nozzle pressure was 4 atm. overpressure.

In case (b) oxygen was blasted with eight main nozzles and eight top nozzles. The nozzles pressure was 10 atm. overpressure and the total oxygen amount 1800 $Nm^3$. In addition, superheated water vapor, temperature 220° C, was blasted with seven main nozzles and seven top nozzles. The used water vapor amount was 1.2 t.

After puddling, the slag was purified with chromium silicate having the analysis Cr 38 %, Fe 18 %, Si 44 %. In case (a) the amount of chromium silicate used was 2340 kg and in case (b) 1210 kg.

| Final slag | | | analysis | | amount |
|---|---|---|---|---|---|
| | $Cr_2O_3$ | FeO | CaO | $SiO_2$ | t |
| a) | 7.7 | 2.5 | 41.3 | 38.5 | 6.3 |
| b) | 11.5 | 3.4 | 34.7 | 40.4 | 3.7 |

| Product ferrochromium | | | analysis | | | amount |
|---|---|---|---|---|---|---|
| | Cr | Fe | C | Si | S | t |
| a) | 53.2 | 44.2 | 1.2 | 1.3 | 0.02 | 15.4 |
| b) | 56.0 | 40.3 | 2.6 | 0.8 | 0.02 | 13.8 |

EXAMPLE 3

Crude iron was refined with a reactor wherein the feeding and drop forming apparatus was dimensioned as follows:

- diameter of the pouring tank opening $\phi$ 25 mm
- falling height from the opening to the dispersing tile 500 mm
- slant of the tile 55° and its width 125 mm
- impinging point of the melt against the tile 30 mm from the tip of the tile
- main nozzles, 15 of them, were horizontal and at a distance of 180 mm from the crude iron film and at such a height that the length of the film produced was 160 mm
- top nozzles, two of them, were directed towards the center line of the drop spray, at a distance of 500 mm. The distance between the impinging points was 1100 mm Crude iron was poured into the reactor at the rate of 11.1 t/h. Burned lime powder and flying dust separated from the discharge gases were injected into the reaction zone, a total of 14 % of the fees amount during the refining. Oxygen was blasted with the main nozzles, and the nozzle pressure was 3.2 atm. overpressure. Air was blasted with the top nozzles, and the nozzle pressure was 1 atm. overpressure.

When the oxygen rate 652 $Nm^3/h$ and the air rate 1410 $Nm^3/h$, the following result was obtained:

| | C | Si | Mn | P | S/% |
|---|---|---|---|---|---|
| Crude iron | 4.2 | 0.9 | 0.8 | 0.09 | 0.035 |
| Product | 0.12 | 0.01 | 0.02 | 0.025 | 0.020 |

In the following trials the dispersing tile was left out and the main nozzles were changed into three nozzles which were directed at the melt flow horizontally, at a distance of 100 m. A corresponding result of refining was not obtained until the oxygen rate was raised to 869 $Nm^3/h$ and the pressure in the nozzles was 5.7 atm. overpressure. Air was blasted from the top nozzles at the same rate, 1410 $Nm^3/h$, as previously.

EXAMPLE 4 a. Ferrochromium was refined with a reactor wherein the feeding and drop formation apparatus was dimensioned as follows:

- diameter of the pouring tank opening $\phi$ 22 mm
- falling height from the opening to the dispersing tile 500 mm, the slant of the tile 45°, and its width 125 mm
- impinging point of the melt against the tile at a distance of 30 mm from the tip of the tile
- main nozzles, seven of them, were at 270 mm from the ferrochromium film and at such a height that the length of the produced film was 160 mm
- top nozzles, two of them, were directed towards the center line of the drop spray, at 500 mm. The distance between the impinging points was 1100 mm.

Ferrochromium was poured into the reactor at 13 t/h. Burned lime powder was injected into the reaction zone in an amount of 7.5 % of the feed by means of a nozzle which had been placed next to the main nozzles. The oxygen pressure in the nozzles was 4.5 atm. overpressure.

b. A reference trial was performed with another type of reactor wherein the nozzles had been placed in a circle around the perforated tile.

- diameter of the pouring tank opening $\phi$ 22 mm
- nozzles, 12 of them, were directed towards the melt flow at an angle of 30°. The distance from the nozzles to the impinging point was 250 mm.

Ferrochromium was poured into the reactor at 13 t/h. Burned lime powder was injected into the reaction zone in an amount of 7.5 % of the feed. The oxygen pressure had to be raised to 25 atm. overpressure.

| Initial ferrochromium | | | | | amount | temperature |
|---|---|---|---|---|---|---|
| | Cr | Fe | C | Si | kg | °C |
| a) | 62.2 | 27.2 | 8.1 | 1.6 | 1100 | 1610 |
| b) | 61.6 | 27.5 | 8.0 | 1.7 | 1500 | 1580 |

Oxygen rate a) from main nozzles 70 $Nm^3/t$ and from top nozzles 29.5 $Nm^3/t$
b) 98.5 $Nm^3/t$

| Slag | | $Cr_2O_3$ | FeO | CaO | $SiO_2$ | amount kg |
|---|---|---|---|---|---|---|
| | a) | 34.8 | 4.5 | 33.3 | 14.4 | 250 |
| | b) | 39.7 | 4.4 | 32.0 | 12.9 | 350 |

| Refined ferrochromium | | | | | amount | chromium yield |
|---|---|---|---|---|---|---|
| | Cr | Fe | C | Si | kg | % |
| a) | 63.4 | 30.2 | 4.3 | 0.1 | 960 | 89.2 |
| b) | 62.9 | 30.3 | 4.7 | 0.1 | 1280 | 87.2 |

In case (a) the reaction occurred evenly and in a controlled manner, whereas in case (b) the reactions were at times explosive and the result of the refining less even.

What is claimed is:

1. A method for dispersing a melt by means of a jet of at least one medium selected from the group of gaseous and liquid media, by causing the melt flow to impinge against a continuous laterally open deflecting surface in the dispersion space to form a thin, widening, laterally unconfined, film of the melt before it meets the jet of the dispersing medium.

2. A method of claim 1, wherein the melt is caused to flow onto a slanted surface to form an even and thin melt film directed slantingly downwards, the film being dispersed immediately by jets of the dispersing medium directed towards the film from under the slanted surface.

3. The method of claim 2, wherein the jets of the dispersing medium are directed substantially horizontally towards the film to produce a mixture of the melt and the dispersing medium, a mixture which is thereafter deflected downwards by means of at least one substance selected from the group of gas and liquid jets directed as it from above.

4. The method of claim 1, wherein themelt flow is caused to impinge against the deflecting surface at a point in the immediate vicinity of the trailing edge of this surface.

5. The method of claim 1, wherein at least one substance selected from the group of gas and liquid is sprayed on each side of the deflecting surface to stabilize the film formation.

6. An improved device for dispersing a melt by means of a jet of at least one medium selected from the group of gaseous and liquid media having a reactor, means for feeding a melt to be dispersed into the reactor; and means for spraying at least one substance selected from the group of gaseous and liquid dispersing media into the reactor towards the melt flow to disperse this flow; the improvement comprising feeding means for dispersing medium fitted in the reactor between the intersection point of the melt and the dispersing medium and the feeding point of the melt; and a continuous laterally open surface slanted in relation to the melt flow and directed away from the feeding means for the dispersing medium to spread this flow into an even and widening, laterally unconfined thin film before it meets the jet of the dispersing medium.

7. The device of claim 6, comprising a slanted surface fitted in the reactor and having an opening formed above the slanted surface for pouring the melt onto the slanted surface to produce an even and thin film; and nozzles fitted below the slanted surface to spray the dispersing medium towards the film.

8. The device of claim 7, in which the distance of the opening from the slanted surface is approximately 500–1000 mm along the melt flow.

9. The device of claim 7, in which the opening has been placed in relation to the slanted surface in such a manner that the melt flow impinges against the slanted surface at 0–200 mm, from its lower edge.

10. The device of claim 6, in which a piece is fitted to the wall of the reactor, said piece being a tile which has a slanted surface directed away from this wall.

11. The device of claim 10, in which the slant of the tile is approximately 5°–60°.

12. The device of claim 8, further comprising additional nozzles directed towards the sides of the tile to direct the jet of the dispersing medium towards the melt optionally flowing along the sides of the tile in order to prevent the melt from flowing onto the nozzles.

13. The device of claim 6, further comprising guide nozzles fitted in the top of the reactor and directed towards the mixture of the melt and dispersing medium in order to deflect the mixture downwards in the reactor.

14. The device of claim 6 wherein the laterally open surface is planar.

15. The device of claim 6 wherein the laterally open surface is convex.

* * * * *